United States Patent [19]

Anderson et al.

[11] Patent Number: 4,671,251

[45] Date of Patent: Jun. 9, 1987

[54] FLUIDIZED BED COMBUSTOR

[75] Inventors: Robert J. Anderson, Toledo; Harold M. Keener, Ashland; James E. Henry, Applecreek, all of Ohio

[73] Assignee: Ohio State University, Columbus, Ohio

[21] Appl. No.: 653,858

[22] Filed: Sep. 24, 1984

[51] Int. Cl.[4] ..... F24H 3/00; F23D 1/00

[52] U.S. Cl. ..... 126/99 R; 431/7; 431/170; 110/347; 122/116

[58] Field of Search ..... 431/7, 170; 122/116, 122/221, 119; 110/243, 244, 245, 250, 254, 259, 263, 347; 165/104.16; 126/99 R

[56] References Cited

U.S. PATENT DOCUMENTS

| | | |
|---|---|---|
| 2,958,298 | 11/1960 | Mayers . |
| 3,171,369 | 3/1965 | Stephens, Jr., et al. . |
| 3,319,587 | 5/1967 | Albertson et al. . |
| 3,596,614 | 8/1971 | Smith et al. . |
| 3,605,655 | 9/1971 | Warshawsky et al. . |
| 3,807,090 | 4/1974 | Moss . |
| 3,834,326 | 9/1974 | Sowards . |
| 3,890,935 | 6/1975 | Moss et al. . |
| 3,897,739 | 8/1975 | Goldbach . |
| 3,921,544 | 11/1975 | Reese . |
| 3,924,402 | 12/1975 | Harboe . |
| 4,021,184 | 5/1977 | Priestly . |
| 4,060,041 | 11/1977 | Sowards . |
| 4,075,953 | 2/1978 | Sowards . |
| 4,084,545 | 4/1978 | Nack et al. . |
| 4,085,707 | 4/1978 | Moss . |
| 4,102,277 | 7/1978 | Wall . |
| 4,116,005 | 9/1978 | Willyoung . |
| 4,154,581 | 5/1979 | Nack et al. . |
| 4,159,683 | 7/1979 | Hughes et al. . |
| 4,178,349 | 12/1979 | Wienert . |
| 4,181,705 | 1/1980 | Gumerman . |
| 4,191,115 | 3/1980 | Yang et al. . |
| 4,253,408 | 3/1981 | Kramer . |
| 4,253,409 | 3/1981 | Wormser . |
| 4,273,750 | 6/1981 | Hollett, Jr., et al. . |
| 4,277,450 | 7/1981 | Dilworth . |
| 4,279,207 | 7/1981 | Wormser . |
| 4,287,156 | 9/1981 | De Feo . |
| 4,300,625 | 11/1981 | Mikhailov et al. . |
| 4,303,023 | 12/1981 | Perkins et al. . |
| 4,309,393 | 1/1982 | Nguyen . |
| 4,314,967 | 2/1982 | Kwon et al. . |
| 4,329,324 | 5/1982 | Jones . |
| 4,338,283 | 7/1982 | Sakamoto et al. . |
| 4,352,332 | 10/1982 | Baston . |
| 4,359,005 | 11/1982 | Baston . |
| 4,372,053 | 2/1983 | Anderson et al. . |
| 4,377,072 | 3/1983 | Campbell, Jr., et al. . |
| 4,529,377 | 7/1985 | Zinn et al. ..... 110/347 X |

OTHER PUBLICATIONS

"Design for Fluidization: Part I"—*Chemical Engineering*—Sep. 17, 1962.

"Design for Fluidization: Part II"—*Chemical Engineering*—Oct. 1, 1962.

"Design for Fluidization: Part III"—*Chemical Engineering*—Oct. 29, 1962.

Technical Paper by Babcock and Wilcox—RDTPA7-9-18.

Paper by Andrew J. Grant entitled "Fluidized Coal Combustion—What Can Be Done Now", presented at Third Annual Conference on Coal Conversion.

Paper entitled "Fluidized Bed Combustion" by D. L. Kearins of Westinghouse Research Laboratories.

"Fluidized Bed Boilers Keep Chinese Industry Running on Marginal Fuels"—*Power Magazine,* Mar. 1983.

(List continued on next page.)

*Primary Examiner*—Larry Jones

*Attorney, Agent, or Firm*—Emch, Schaffer, Schaub & Porcello Co.

[57] ABSTRACT

The invention relates to a method and apparatus for combusting a dirty and/or difficult to burn fuel in a fluidized bed combustor. The fluidized bed and freeboard zone of the combustor are cooled by a non-intrusive counterflow cooling system which controls combustion temperatures and produces a clean, hot gas. The combustor is operated with many combinations of features including: low, in bed fuel injection; use of finely divided fuel; slug flow fluidization; and injection of lime or limestone to effect desulferization or raise the ash melting temperature, if desired.

15 Claims, 7 Drawing Figures

OTHER PUBLICATIONS

"How to Choose the Right Fluidized Bed Boiler"—*Power Magazine,* Dec. 1982.

"FBC May Be a Better Way to Burn Coal"—*Chemical Week*—Sep. 22, 1976.

Fluidyne Engineering Corporation brochure entitled "Fluidized Bed Combustion Systems, FBC Boilers and Heaters".

"Fluid-Bed Coal Combustors Commercialized"—*Chemical and Engineering News,* Feb. 6, 1978.

Wormser brochure entitled "Wormser Grate: A Whole Way to Burn Coal".

Article entitled "Corncob Burner Prototype Developed and Tested", published in *Ohio Report,* 67(4):71-Jul.-Aug., 1982.

Paper entitled "Development of a Fluidized-Bed Corncob Combustor", presented at Solar and Biomass Energy Workshop, Apr. 13-15, 1982.

Fact sheet dated Feb. 8, 1983, entitled "Corncobs as Fuel Source".

Paper entitled, "Performance of an Automatically Controlled Fluidized Bed Corncob Combustor", prepared for Solar and Biomass Energy Workshop, Atlanta GA., Apr. 26-28, 1983.

News release dated Jun. 29, 1983, entitled "Ohio Scientists Develop a New Efficient Cob-Burning Furnace".

Paper No. 83-3037 entitled "Controllable Fluidized Bed Direct Produces Clean High Temperature Air:, " for presentation at the 1983 summer meeting of the American Society of Agricultural Engineers, Jun. 26-29, 1983.

Newspaper article entitled "Corncobs Burn Bright as Future Fuel", dated Mar. 4, 1983.

Newspaper article entitled "Corncobs as Fuel", dated Mar. 15, 1983.

Article entited "Cob Burner Passes Trials", published in *News in Engineering,* Mar. 1983.

FLUIDIZED BED COMBUSTOR

The present invention relates an improved fluidized bed combustor intended, among other uses, to provide a high temperature, clean gas (such as air) for use in the intermittent or continuous operation of hot gas turbogenerating systems, heating and processing systems, or combinations of these. While fluidized bed combustors have shown intriguing potential for use as clean, environmentally sound combustion systems, there are still persistant technological problems to be solved in the management and control of the operation of the fluidized bed combustor.

Current state-of-the-art fluidized beds are generally operated in an aggregative flow mode in which the heated bed particulates are fluidized in a slightly expanded condition in relation to the condition of the bed at rest. Air is introduced from beneath the bed for purposes of fluidization and combustion. Fuel is also introduced into the heated bed. Ignition takes place and the fuel burns in the presence of the combustion air. A major share of the heat produced by such combustion is absorbed by the bed particulate. The absorbed heat is then transferred from the bed particulate or media to a cooling fluid, most often water, by means of a heat exchange apparatus immersed within the bed. Also, as the combustion continues, the fluidizing gas or air is transformed with the fuel to the products of combustion or combustion gases.

As the combustion gases rise through the bed, the bed particulate moves at random and a gentle "boiling" action can be observed at the top surface of the bed. In aggregative flow fluidization, there is little intrusion of the fluidized bed particulate into the open region or freeboard zone located within the vessel above the bed. Consequently, two separate and distinct zones are established within the vessel: the fluidized bed and the freeboard zone above the bed.

Problems have been encountered when fluidized beds are operated in the accepted aggregative flow mode near the stoichiometric conditions required for high efficiency burning. One of the problems is melting of the ash. When the ash melts within the particulate bed the media particles agglomerate and fluidization stops.

Attempts to extract heat and, at the same time, control the extreme temperatures within the bed have concentrated on the use of heat exchange tubes which are passed through the bed and through which a cooling fluid flows. The use of such heat exchange tubing has been somewhat successful in heat extraction and in controlling the bed temperatures sufficiently to avoid ash agglomeration. See, for example, the DeFeo U.S. Pat. No. (4,287,156), and the Kwon et al. U.S. Pat. No. (4,314,967), which disclose the use of vertical heat exchange tubing buried within the bed. Others have attempted to control the bed temperatures by extending horizontal tubing through the bed. See, for example, the Moss U.S. Pat. No. (4,085,707).

Successful incorporation of heat exchange tubing into the overall design of fluidized bed combustors has been mitigated by numerous operational problems. Horizontal tubing is subjected pulsating mechanical forces from the fluidized media. Flexing of the tubes from these forces causes stress reversal at the tube anchorage points and premature failure results from metal fatigue. In boilers, water leakage at these points of failure causes severe corrosion problems. Leakage causes solidification of the bed media when such a boiler is shut down for repairs. Removal of solidified material adds to maintenance and repair costs. Another problem associated with pulsations of the bed media is premature failure due to erosion of the undersides of the tubes.

In fluidized beds with imbedded horizontal tube heat exchangers cooled by a gas such as air, the main problem is temperature limitation due to the loss of strength of the tube material at high temperatures. It is difficult to heat the gas to minimum requirements (1500° F.) necessary for hot gas turbine operation because of this limitation.

In beds with large areas, it is difficult to distribute fuel and air in ideal proportions. Consequently, local cyclic oxidizing/reducing atmospheres, in contact with heat exchanger tubing, prevent the effective buildup of protective metal oxides on the tubing surfaces and excessive corrosion results limiting tubing life. This is especially true when sulfur bearing fuels such as coal, are burned.

Further problems have been encountered in controlling the temperatures within the freeboard zone during the aggregative fluidized combustion process. In most combustors, some fuel particles continue to burn as they float on the surface of the fluidized bed. Such continued combustion releases heat to the freeboard zone and may cause the temperature within the freeboard zone to reach levels at which the exhausting ash melts and fouls the freeboard space walls and downstream piping and equipment. Therefore, it is necessary to control the temperatures within the freeboard space as well as the bed to prevent ash agglomeration. Attempts to control the freeboard temperatures can sometimes become quite elaborate. See, for example, the Warshawsky et al. U.S. Pat. No. (3,605,655) and the Nash et al. U.S. Pat. No. (4,084,545).

While fluidized bed combustors offer many opportunities to provide clean, high temperature fluids for use in heating and processing applications, as well as electrical generation, problems are still present which deny the fluidized bed combustor the necessary reliability and continued efficiency for widespread extended use in such applications.

The present invention provides a reliable and efficient fluidized bed combustor that consumes biomass, coal and other difficult to burn or "dirty" fuels (solid, liquid or gaseous) and provides a high temperature, clean gas for operating a hot gas turbogenerating system or for processing and heating without causing appreciable environmental pollution.

The apparatus and methodology of the present invention provide a fluidized bed which operates better in a "slug flow" mode than in an aggregative flow mode, and is cooled by a unique non-intrusive counterflow cooling system using a gas as the cooling fluid. Slug flow is associated with high gas velocities, large bed particles, and beds with large height to diameter ratios, either singularly or in various combinations. Slug flow of the bed particulate is characterized as a violent pulsating action which resembles lava eruptions from a volcano. When slug flow is compared with the gentle boiling action of state-of-the-art aggregative flow fluidized beds, it can be seen that the particle translation is less random and more vertical. These pulsating excursions of material into the freeboard region during slug flow make it difficult to define a distinct freeboard zone, as in aggregative flow fluidization.

Counterflow cooling of the exterior of the vessel wall combined with slug flow fluidization within the vessel and the feeding of finely divided fuel into the bottom of the fluidized bed along with the combustion air produces a unique heat exchange relationship. A significant but gradual negative temperature gradient is established from a point in the lower region of the fluidized bed to the top of the freeboard space within the vessel. A positive temperature gradient is established in the counter-flow cooling gas surrounding the vessel as it flows from the top of the freeboard space to the lower region of the fluidized bed. The saluatory effects of this heat exchange arrangement are three: (1) Maximizing the cooling gas outlet temperature, (2) Minimizing the combustion (dirty) gas outlet temperature, and (3) Maximizing the total heat exchanged.

In addition to these enhanced heat exchange advantages are three other operational advantages: (1) Maximizing of combustion efficiency, (2) Elimination of sticky ash particulate, and (3) Elimination of the problems associated with heat exchange tubes immersed in the bed. The methods and apparatus of this invention exhibit distinct improvements over current state-of-the-art technologies and methodologies.

SUMMARY OF THE INVENTION

The present invention provides a method for the efficient combustion of difficult to burn or dirty fuels, such as biomass and high sulfur coal, refinery bottoms and biogas in a fluidized bed combustor to provide, by means of a heat exchanger, a clean, high temperature gas for use in hot gas turbines, heating and processing systems, while exhausting to atmosphere the products of combustion in an environmentally sound manner. Virtual completion of the combustion process occurs within the fluidized bed zone of the combustor. Finely divided fuel along with combustion air is injected into the lower region of the fluidized bed.

By finely divided fuel is meant the range of particle sizes, for any given fuel, which is substantially burned within the bed zone of the combustor. (For slug flow operation, the bed zone is considered to be the space occupied by the bed at rest). Liquid and gaseous fuels are finely divided by nature. Liquids and gases and most solids finer than 8 mesh burn to virtual completion within the lower region of the fluidized bed zone. Finely divided fuel is therefore rapidly and efficiently burned.

The temperatures within most of the bed above the point of fuel injection and with the entire freeboard zone decline as combustion gases rise. These temperatures and are limited by a unique counterflow cooling system. A gas, such as air, acts as a heat exchange medium to remove heat at a controlled rate thereby preventing ash melting and at the same time promoting efficient, clean burning. Efficient energy conversion, heat transfer and temperature control is further enhanced by operating the fluidized bed combustor in a "slug flow" mode in which there are frequent pulsations of slugs of bed particulate through the freeboard zone of the fluidized bed combustor. Where need for desulfurization or elevating of ash melting temperatures exist, lime or limestone can be introduced with the fuel or separately within or above the bed zone.

The present invention also provides an apparatus for achieving the methodology of the invention. The preferred apparatus includes a first vessel containing the particulate of the fluidized bed or bed media, and a second vessel or shell which substantially surrounds the first vessel. An annular space is defined between the first and second vessels. A fuel feed means is located proximate the bottom of the fluidized bed and injects fine particulate fuel, and lime or limestone if required, mixed with combustion air into the bottom of the bed in a dispersed pattern. Cooling gas, such as air, is supplied, via a cooling gas feed means, into the annular chamber located between the first and second vessels. The cooling gas flows from the uppermost portion of the vessels to a location near the bottom of the fluidized bed, where it exits.

The fluidized bed combustor of the present invention operates as follows. A combination of fuel and combustion air is injected into the lower region of the heated fluidized bed, where ignition occurs. Combustion is virtually completed within the fluidized bed zone. In the preferred operating mode the combustion gases have a velocity sufficient to propel slugs of the bed media through the freeboard zone of the first vessel. These frequent excursions of slugs of bed media along with associated hot combustion gases carry heat to the freeboard zone of the first vessel. Heat is transferred from both the fluidized bed and the freeboard zones through the vessel wall to the cooling gas which is injected into the top of the second vessel and which flows through the annular space between the first and second vessels in a direction counter to the flow of the combustion gases moving through the first vessel. A negative temperature gradient is established in the combustion gas flow from a point near the bottom to top within the first vessel, and a positive temperature gradient is established in the cooling gas flow from top to a point near the bottom through the annular space between first and second vessels. The cooled combustion gases exit from the top of the first vessel carrying along solidified (non-sticky) ash particles. The heated cooling gas is most ideally exited from a level somewhat above the bottom of the second vessel where combustion temperature has peaked within the first vessel. This heated cooling gas provides an ideal clean, external heat source for a hot gas turbine or high temperature heating or processing system. Preheating of fluidizing and/or cooling gas flows by recuperating waste heat from combustion gas and/or turbine exhausts enhances overall operation. Control of temperature profile within the combustor is achieved by sensing a single temperature within the bed and modulating cooling gas flow to hold that temperature virtually constant.

The method and apparatus of the present invention overcome many of the problems associated with current fluidized bed combustors. The fluidized bed combustor of the present invention maximizes cooling gas temperature and improves ash fushion control capability, heat exchange capability and thermal efficiency. The fluidized bed combustor of the present invention eliminates immersed heat exchange tubes and their associated erosion, corrosion and fatigue fracture problems. Significantly higher cooling gas temperatures can be achieved, not only because of the inherent advantages of counterflow heat exchange, but because of the vertical, non-intrusive heat exchanger configuration. Metals softened by temperatures as high as 2000° F. maintain structural integrity because only the small static forces of tension and compression are imposed on heat exchange structures (rather than the dynamic, reversing bending stresses resulting in immersed horizontal tubes where such operating temperatures are not presently practical). The fluidized bed combustor of this invention is versatile and adaptable to a wide range of fuels without encountering significant structural, abrasion or corrosion problems. It controls gaseous pollutants and is simple to operate.

Other advantages and features of the invention will be apparent from the following description and drawings relating the preferred embodiment.

DETAILED DESCRIPTION OF THE DRAWINGS

Figure 1:
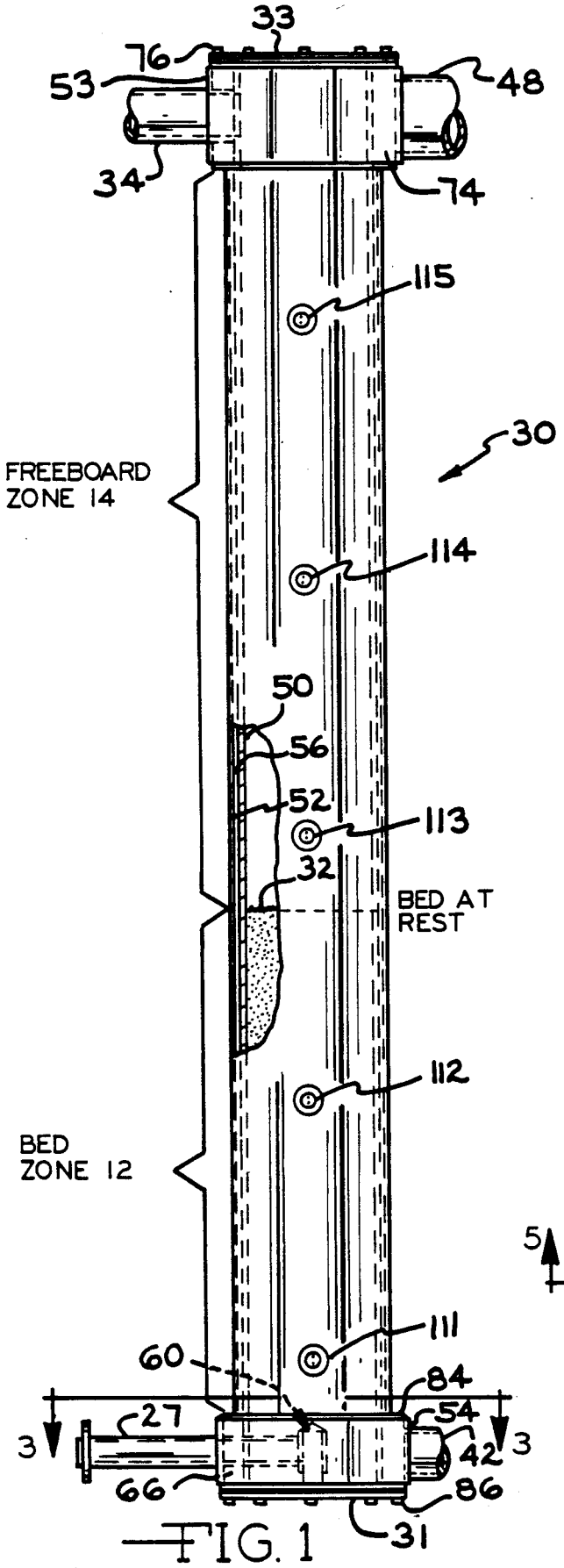
FIG. 1 is an elevational view, partially cutaway, of the fluidized bed combustor of the present invention.

Referring now to FIG. 1, the fluidized bed combustor 30 of the present invention includes a first vessel 50 with a bottom plate 31, and a top cover plate 33. The bed of particulate media 32 is contained in the first vessel 50. A second vessel or outer heat exchanger shell 52 surrounds the first vessel 50 such that the vessel 50 and shell 52 define a longitudinally extending annular space 56 between the outside surface of the first vessel 50 and the inside surface of the shell 52.

Figure 2:
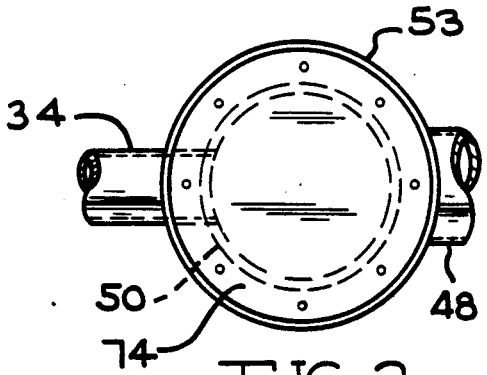
FIG. 2 is a plan top view of the fluidized combustor of the present invention.
Figure 3:
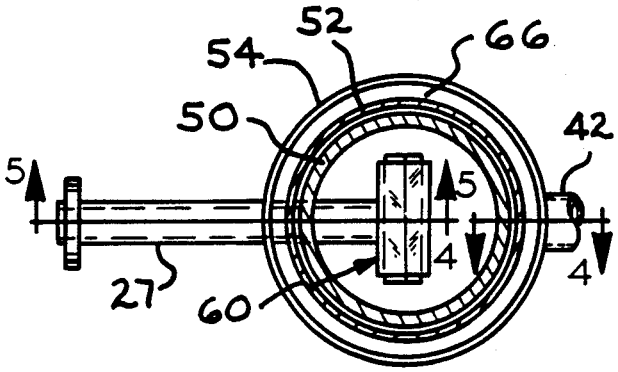
FIG. 3 is a cutaway view taken along line 3—3 of FIG. 1.
Figure 5:
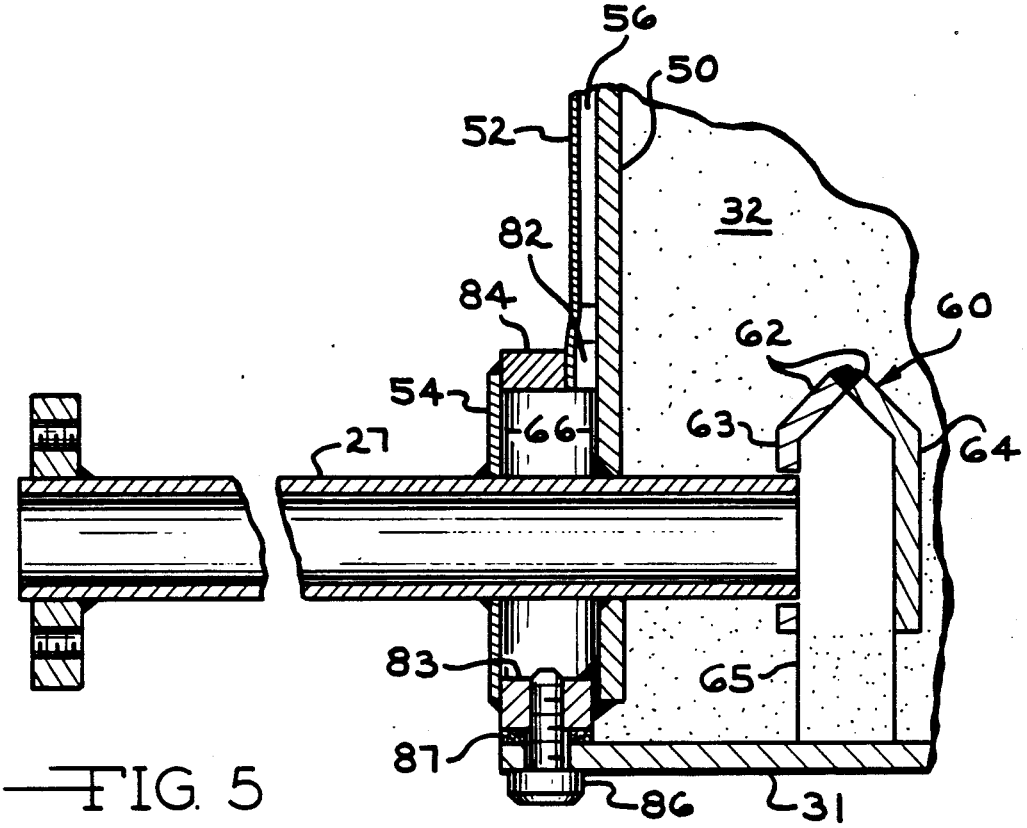
FIG. 5 is a cutaway view taken along line 5—5 of FIG. 3.

Referring now to FIGS. 2 and 3, the fluidized bed combustor 30 further includes a top cooling gas distribution plenum 74, formed in part by an outside wall 53 spaced from and concentric with the vessel wall 50. A bottom cooling gas exhaust plenum 66 is formed in part by a second outside wall 54, spaced from and concentric with the vessel wall 50. An inlet pipe 27 located proximate the bottom of the fluidized bed combustor 30 carries a mixture of fluidizing/oxidizing gas and fuel into the fluidized bed 32. In the preferred embodiment, the fluidizing/oxidizing gas is air. Referring briefly to FIG. 5 it can be seen that the inlet pipe 27 penetrates the second outside wall 54 and the vessel wall 50. The inlet pipe 27 terminates at a hood member 60 which is buried in the particulate bed media 32. The hood member 60 includes a generally V-shaped top portion 62, vertical side walls 63, 64 and end walls 65 which extend to the bottom plate 31. Side wall 64 is opposed to the inlet pipe 27 and the fuel and air mixture flowing from the inlet pipe 27 into the hood member 60 is forced downward and outward from under the hood member 60 by side walls 63, 64 and the end wall 65. The end walls 65 provide support for and assist in retaining the hood member 60 in a substantially permanent position.

As the fuel and air mixture emerges from the bottom of the hood member 60 it spreads in a diffuse pattern across the entire cross-section of the bed 32. The fuel and air mixture then flows upwardly through the vessel 50 toward the combustion gas exhaust pipe 34. The fuel is ignited by the hot media 32 in the region of the hood 60 and combustion is virtually completed within the bed zone 12. The resulting hot combustion gases impart heat energy to the particulate media which, in turn, imparts heat energy to the vessel wall 50 for removal by the counterflow cooling gas.

Referring now to FIGS. 1 and 2, the cooling gas, which is also air in the preferred embodiment, enters the top distribution plenum 74 through the cooling air inlet pipe 48 which is fixed to the outside wall 53. The cooling air flows from the top distribution plenum 74 and travels downward through the annular space 56 formed by the vessel wall 50 and outer heat exchanger shell 52. As the cooling air travels through the annular space 56, it absorbs the heat conducted through the vessel wall 50. Thus, the temperatures within the vessel 50 are controllable by varying the flow rate of the cooling air.

Figure 4:
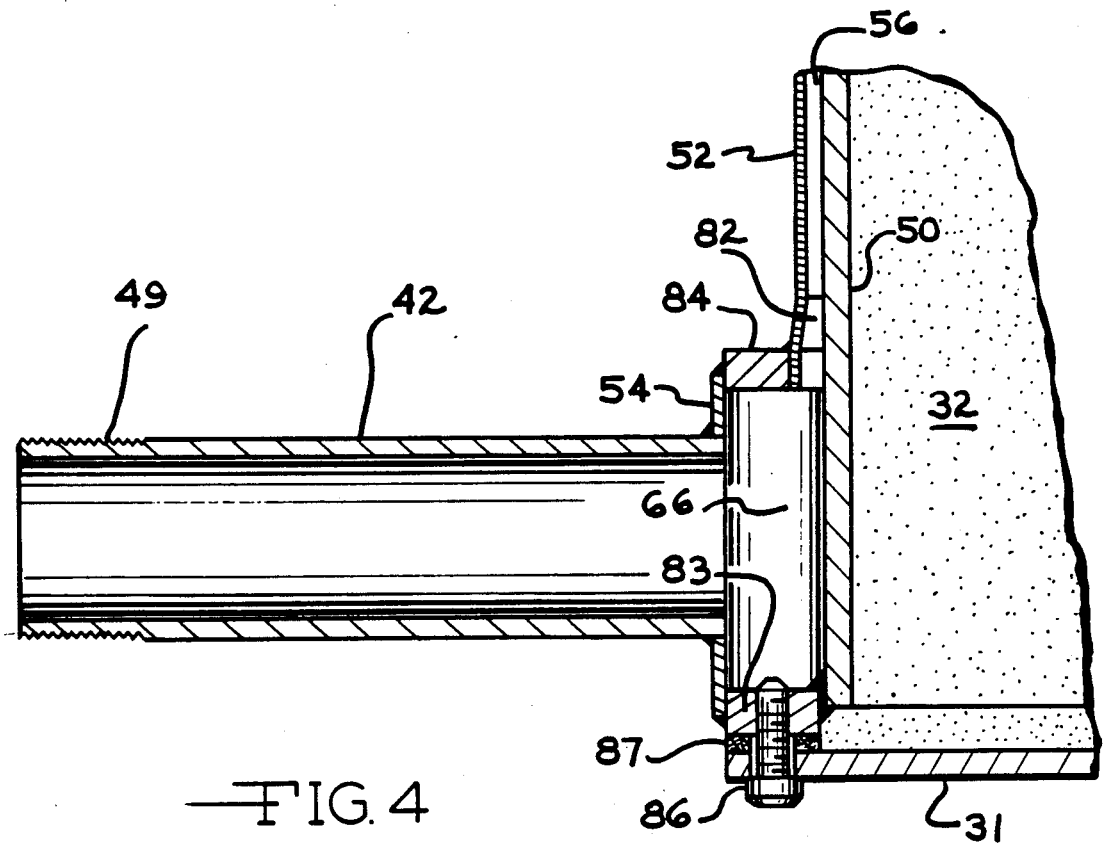
FIG. 4 is a cutaway view taken along line 4—4 of FIG. 3.

The bottom plenum and cooling air exhaust pipe 42 are shown in detail in FIG. 4. The bottom plenum 66 is formed by the vessel wall 50, the plenum outer wall 54, and the lower ring 83 and upper ring 84. The annular space 56 communicates with the bottom plenum 66 through the diverging annular space 82. The heated cooling air flows from the annular space 56 through diverging annular space 82 into the bottom plenum 66. The cooling air then exhausts through the exhaust pipe 42, carrying with it the heat removed from the vessel wall 50.

In the preferred embodiment of this invention, the vessel 50 is substantially cylindrical in shape and is approximately 6 inches in diameter and 5 feet 6 inches high. The unexpanded particulate media depth is about 24 inches. The vessel 50, heat exchanger shell 52, and pipes 34, 42 and 48 are preferably made of a stainless steel material capable of withstanding the heat and the corrosive effects of the combustion gases and hot ash. However, it should be understood that other materials, such as ceramic coated metals may also be used.

Figure 6:
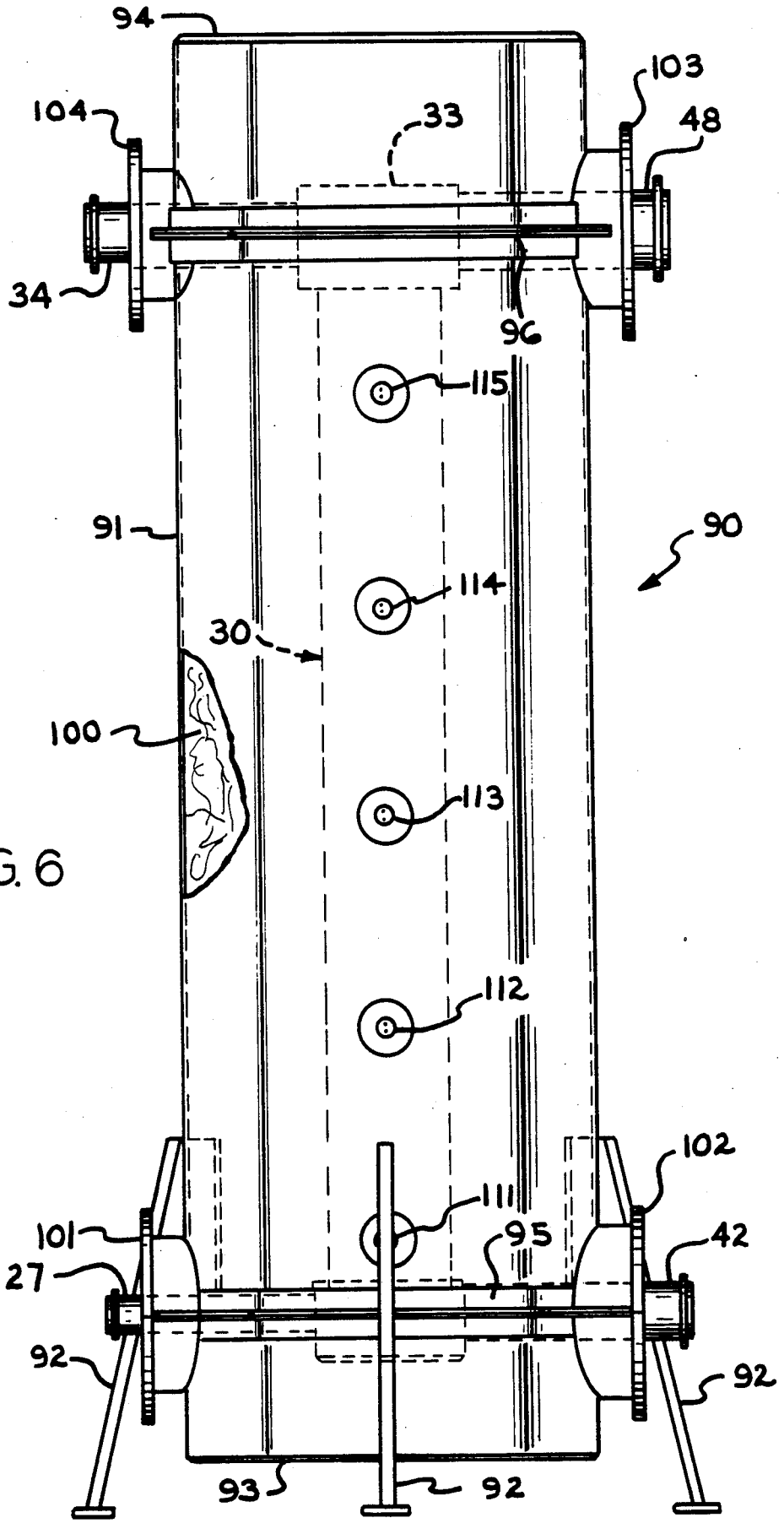
FIG. 6 is an elevational view, of the fluidized bed combustor and outer casing of the present invention.

Referring now to FIGS. 1 and 6, and in particular to FIG. 6, the fluidized bed combustor 30 is shown in phantom, within an outer casing 90. The outer casing 90 is constructed of a mild carbon steel material and includes a casing wall 91 and a plurality of support leg members 92 which extend from the lower portion of the casing wall 91. A bottom member 93 and a top member 94 are respectively fixed to the bottom and top of the casing wall 91 by flange members 95 and 96. The fluidized bed combustor 30 is centered within the outer casing 90 and the heat exchanger shell 52 is spaced from the casing 91. Insulation material 100, such as loose fill pearlite insulation, is placed in the space formed between the shell 52 and the casing wall 91 to prevent undue heat loss from the fluidized bed combustor 30.

The outer casing 90 includes connection sleeve member 101 which is fixed adjacent the lower portion of the casing wall 91 and bottom member 93 and is situated perpendicularly to the casing wall 91. The sleeve member 101 coaxially surrounds the inlet pipe 27. The outer casing 90 includes a second connection sleeve member 102 which is fixed positioned adjacent the lower portion of the casing wall 91 and bottom member 93 and is substantially 180° disposed from the first connection sleeve 101. The second sleeve member 102 coaxially surrounds the cooling air exhaust pipe 42. A third connection sleeve member 103 is fixed adjacent the upper portion of the hollow member 91 and the top member 94 and is perpendicular to the casing wall 91. The third sleeve member 103 coaxially surrounds the cooling air inlet pipe 48. A fourth connection sleeve member 104 is also fixed adjacent the upper portion of the casing wall 91 and the top member 94 and is substantially 180° disposed from the third connection sleeve member 103. The fourth connection sleeve member 104 coaxially surrounds the combustion gas exhaust pipe 34. The connection sleeves 101, 102, 103 and 104 are filled with insulating material to prevent heat loss.

A plurality of pipes 111, 112, 113, 114 and 115 extend from the interior of the vessel 50 through the heat exchanger shell 52, the insulation material 100, and the casing wall 91 to the exterior of the outer casing 90. Thermocouples (not shown) are placed in the pipes 111–115 to monitor the temperature at differing elevations during the operation of the fluidized bed combustor 30. A sample of the data generated by the thermocouples 111–115 along with others in inlet and outlet pipes provide the temperature information contained in the graph of FIG. 7. In this embodiment, the thermocouple in pipe 112 is utilized to automatically control the temperature of the operating fluidized bed combustor 30.

In operation, a fuel/air mixture with approximately 20% excess air is injected through the inlet pipe 27, FIG. 1, into the lower region of the bed zone 12. The hot bed media ignites the fuel and combustion is virtually completed within the bed zone 12. The bed 32 is fluidized by the upward flow of air and hot combustion gases resulting from the burning of the fuel. Fine particulate ash (in the case of burning any ash containing fuel) entrained in the combustion gases rises and exits the vessel 50 at the top of the freeboard zone 14, through the combustion gas exhaust pipe 34.

The combustion gases carry off a portion of the combustion heat. The major portion of the combustion heat is absorbed by the cooling air flow which enters the top of the combustor 30 through pipe 48 and exits at the bottom through pipe 42. The flow of cooling air surrounds the inner vessel 50, being contained by concentric outer vessel 52, and moves downwardly through the annular space 56 between the vessels in a direction opposite the flow of combustion gases within vessel 50.

FIG. 1 shows the approximate level of the particulate media 32 when the combustor is not operating. The bed of media at rest fills about 40% of the volume of the inner vessel 50. During operation, the bed 32 expands. If this bed 32 is operated in an aggregative flow mode, the expansion of the bed increases the volume of the now fluidized bed slightly, perhaps to about 45% of the volume of vessel 50. Such aggregative flow would be characterized by a bed 32 which resembles the boiling of water, wherein the particulates within the bed 32 move randomly. This type of operation can be achieved within the apparatus of the invention by using sand of 60–80 mesh and with specific combustion air velocities in the range 0.5 to 1 ft/sec. In the aggregative mode of operation, fouling of the freeboard zone 14 by a buildup of particulate ash becomes a problem and as ash accumulates, the effectiveness of heat exchange in the freeboard zone 14 diminishes.

The preferred method of operation of the apparatus of this invention is to use coarser media (7 to 12 mesh) and increase the specific combustion air velocities to about 1.8 ft/sec. or greater, establishing a slug flow condition within the vessel 50. In slug flow, the upper portion of the bed 32 pulsates violently and frequent eruptions propel slugs of media through the freeboard region 14 to the top of the inner vessel 50. The pulsations of particulate media becomes less violent deeper down in the bed 32. In the lower regions of the bed 32, the essential characteristics of aggregative flow are maintained. If the fuel injected therein is finely divided enough, most of the combustion will occur within this lower aggregative flow region.

The slugs of bed particulate, propelled through the freeboard zone 14, greatly facilitate heat transfer from the freeboard zone 14. This occurs for four reasons: (1) The hot media excursions sweep the inner vessel 50 side walls in the freeboard zone 14 and eliminate fouling due to ash buildup (when ash containing fuels are burned); (2) The hot media excursions turbulate the combustion gas in the freeboard space 14 improving the convective heat movement to the side wall of vessel 50; (3) The hot media slugs propelled into the freeboard zone 14 emit radiant energy which is instantly absorbed by and conducted through the side wall 50 of the vessel; (4) The thickness of the static gas film which occurs along the side walls 50 of the freeboard zone 14 is reduced by the scrubbing action of the media thus decreasing the insulating effect of the gas film.

Combustion efficiency of the apparatus of the present invention is extraordinarily high because of the early buring of the finely divided fuel particles within the bed zone 32. Also, the excursions of hot media into the freeboard zone 14 turbulently mix the remaining oxygen and fuel particles with the not uncombusted gases and ash. This mixing enhances completion of combustion. It is important to keep the upper freeboard zone temperature below the ash sintering temperature.

Maximization of the cooling air outlet temperature (for more effective and efficient hot gas turbine operation) and of overall combustion and thermal efficiencies is achieved by recuperating waste heat from exhausted combustion gases and/or cooling air (turbine exhuast gas) and utilizing the heat recuperated for preheating the combustion/fluidizing air and/or cooling air flows.

Because of the early burning of the fuel in the lower region of the bed zone 12 and because of the stablization effects of both counterflow cooling and slug flow operation, the temperature profiles within the bed zone 12 and freeboard zone 14 remain virtually constant, assuming constant flows of combustion/fluidizing air, cooling air and fuel. It is therefore practical to control the entire combustion/heat exchange process from one thermocouple located in the fluidized media of the lower region of the bed zone 12. (The critical factors are ash fushion at the point of highest temperature and ash sintering at the combustion gas outlet 34 and downstream of that point). By appropriate electronic and mechanical means, the signal from this thermocouple modulates the flow of cooling air to hold the associated temperature and all other temperatures within the combustor virtually constant.

Figure 7:
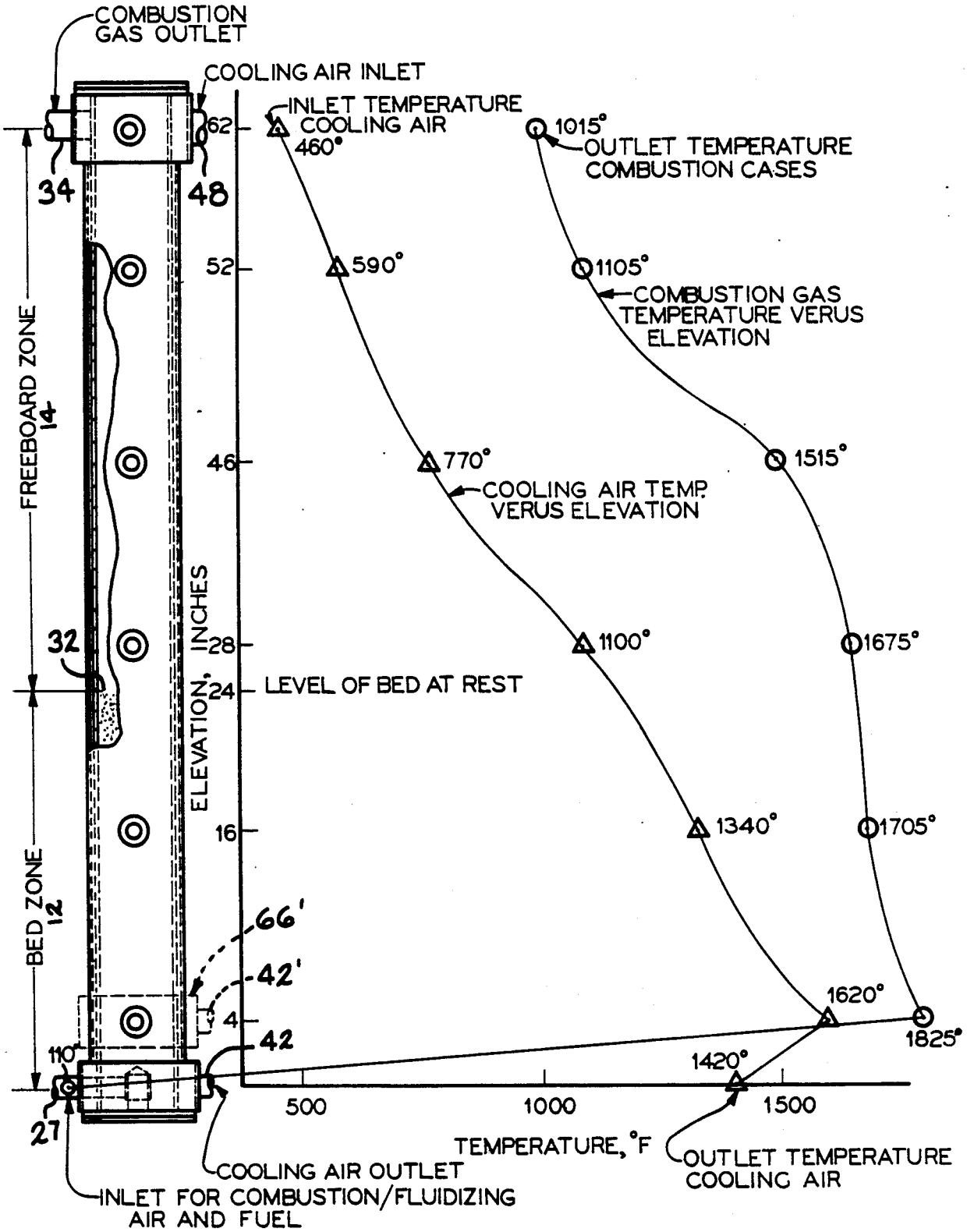
FIG. 7 is an elevational view of the fluidized bed combustor of the present invention, partially cutaway accompanied by a graph showing various temperatures recorded along the operating fluidized bed and freeboard space corresponding to the elevation.

FIG. 7 illustrates a laboratory test of the apparatus of this invention. The unit was operated in the slug flow mode. The media was 7–12 mesh sand. The fuel was minus 6 mesh coal. The cooling gas was air. The unique heat transfer characteristics of this invention are apparent from the graphs showing the temperatures of both combustion gas and cooling air at various levels of the combustor. Note that the temperature of the combustion gas (and also the sand) below the 28 inch level declines slighty from the high point of 1825° F. at the 4 inch level to 1675° F. at the 28 inch level. Within the space between these two levels, combustion is virtually completed. Heat of combustion is directly absorbed by the sand and transferred through the vessel wall 50 to the counterflow cooling air. As the combustion gas above the 28 inch level is cooled from 1675° F. to 1015° F. at the outlet 34, additional heat is removed from both combustion gas and slugs of sand and is transferred through the wall 50 of the freeboard zone 14. Freeboard zone cooling also assures no sticky ash problems downstream.

In the process, the cooling air is heated from 460° F. at the inlet 48 to approximately 1620° F. at the 4 inch level. Control of the temperatures within the combustion vessel 50 is easily achieved by modulation of the cooling air flow.

In the bottom 6 inches of the combustor (2 inches below and 4 inches above the fuel inlet 27), the combustion/fluidizing air is heated from 110° F. at the inlet 27 to 1825° F. at the 4 inch level. As this combustion/fluidizing air is heated between the range of 600° F. to 1200° F. the fuel (coal) is partially pyrolized, i.e., the burnable gases are volatilized from the coal. The heat required for elevating the combustion/fluidizing air temperature and the heat required to pyrolize the coal are supplied by the fluidized hot sand. When the temperature of air, pyrolysis gases and fuel particles reaches about 1200° F. extremely rapid combustion of the fuel is accomplished. The major portion of the fuel is consumed within the proximate region of the 4 inch level.

The counterflow cooling air of this test was cooled from 1620° F. at the 4 inch level to 1420° F. at the outlet 42. Some of the heat picked up from the freeboard zone 14 and the bed zone 12 above the 4 inch level was fed back into the fluidized sand, combustion air and pyrolysis products below that level. Through this phenomenon aided in the process of rapid combustion, it had the disadvantage of lowering the cooling air outlet temperature by 200° F. This would have a significant negative effect in utilizing the cooling air output from outlet 42 as the input for a hot gas turbine. (Turbine efficiency increases with increase in input temperature).

The preferred embodiment is therefor indicated in phantom on FIG. 7. The cooling air outlet 42' and outlet plenum 66' are raised above the combustion/fluidizing air and fuel inlet 27 to the level where the cooling air temperature is maximized. Preheating the combustion/fluidizing air by recuperating heat from the exhausted combustion gases improves the process further, maximizing the cooling air temperature and increasing the thermal and combustion efficiencies of the process.

Because the combustor 30 is surrounded by a heavy layer of insulation 100, as shown in FIG. 6, automatic intermittent operation of the combustor 30 is feasible. Shutdown is accomplished by stopping the flow of fuel, combustion air and cooling air. Heat is retained within the bed 32 over extended periods of time. Restarting is accomplished by sequentially and automatically restarting the flows of combustion/fluidizing air, fuel and cooling air.

The present invention may include, if desired, a heat exchanger (not shown) located in the downstream combustion gas flow which serves to preheat the cooling fluid as it enters the annular space 56 through pipe 48 and, thereby increase the overall efficiency of the combined system as explained above. The invention may also include a downstream cyclone (not shown) for use in removing entrained ash from the combustion gas exhaust. The cyclone can be cooled by the cooling gas before the cooling gas is introduced into the heat exchanger 52 of the combustion vessel 30.

To facilitate cold startup of the fluidized bed combustor system of this invention, the media particulate must be preheated to a predetermined threshold temperature. This is accomplished in the present apparatus by passing low velocity hot air (1000° F.) through the static bed 32 until the average bed temperature reaches about 900° F. An external electric heating element or any other suitable heating source may be used to accomplish this task. Normal operation then proceeds as described earlier. After the bed 32 temperature achieves its threshold limits, the external preheater will not be used again unless prolonged shutdown causes the bed temperature to decline below the predetermined startup threshold.

In embodiments for use in consuming sulfur bearing fuels such as coal, the fluidized bed combustor provides an excellent teatment zone for the desulfurization of the fuels, if needed. The desulfurization of combustion gases containing sulfur dioxide is accomplished by reacting the combustion gases with limestone, or lime. The ideal temperature for such desulfurization ranges from 1500° F. to 1600° F. Referring again to FIG. 7 it can be seen that the ideal desulfurization temperatures occur within the freeboard zone 14. If the cooling air inlet 48 is located closer to the bed 32; the freeboard zone 14 can then be held near optimum desulfurization temperatures. The introduction of finely divided lime into this zone 14 is effective in desulfuring the exhaust gases.

The fluidized bed combustor of the present invention is very effective in burning biomass fuel. Previous experience in burning biomass indicates that biomass is difficult to utilize as a fuel because the ash formed in the combustion of most biomass material generally has a low melting point. For example, the ash of corncobs has been shown to have a threshold melting point of around 1450° F. Such a low threshold melting temperature makes it impractical to use most biomass along as a clean efficient energy source for high temperature application. It has been found that the introduction of lime or limestone along with biomass into the fluidized bed of the present invention will allow the combustor to operate at much higher temperatures and produce clean efficient burning, without incurring ash melting problems.

The present invention incorporates counterflow cooling of a fluidized bed combustor by a flow of clean gas with many possible combinations of features including but not limited to: (1) low, in bed fuel injection, (2) finely divided fuel (particulate, liquid or gaseous), (3) slug flow fluidization, (4) desulfurization using lime or limestone, and (5) raising ash melting temperature using lime or limestone. Any such combination results in a unique new type of fluidized bed combustor which makes its use of great commercial value as an external heat source for the operation of hot gas turbine driven equipment (including generators) and/or as a heat source for processing and space heating especially where cleanliness and protection of health are important.

The above detailed description of the present invention is given for explanatory purposes. It is to be understood that the methods of this invention are applicable when other fluids besides a gas such as air are utilized as the cooling medium. Liquid sodium, liquid salts, water under pressure or other liquids may be utilized. The fluidized bed combustor of this invention therefore can be used to heat fluids for a wide variety of applications. It will be apparent to those skilled in the art that numerous other changes and modifications can be made in the preferred embodiments of the invention described above without departing from the scope of the invention. Accordingly, the whole of the foregoing description is to be construed in an illustrative and not in a limitative sense, the scope of the invention being defined solely by the appended claims.

We claim:

1. An improved fluidized bed combustor apparatus for producing a clean heated fluid, said fluided bed combustor defining a bed of particulate media and a freeboard zone above said bed, said apparatus comprising, in combination:

a first vessel containing said bed of particulate media and said freeboard zone;

a second vessel spaced from and surrounding said first vessel, defining a longitudinal annular space between said first vessel and said second vessel;

means for supplying a finely divided fuel and an oxidizing gas to said bed for combustion connected proximate the bottom of said first vessel, said supply means passing such fuel and gas and the resulting combustion gases through said bed to fluidize said media particulate, said media particulate absorbing the heat of combustion creating a negative temperature gradient extending from a point proximate the bottom of said bed of particulate media upwardly through said freeboard zone; and, means for providing a flow of cooling fluid within said annular space counter to the flow of said fuel and gases within said first vessel, said cooling fluid abosrbing heat from said first vessel to enhance and regulate said negative temperature gradient in said first vessel.

2. The apparatus of claim 1 in which said fluidized bed combustor consists of two or more sets of said first and second vessels.

3. The apparatus of claim 1 or 2 further including a preheater means operatively connected to said first vessel to facilitate raising the temperature of said bed of particulate media to a minimum temperature necessary for combustion.

4. The apparatus of claim 1 or 2 wherein said fuel substantially combusts at a location proximate the bottom of such fluidized bed.

5. The apparatus of claim 1 or 2 wherein said fuel supply means further includes a means for mixing said fuel with said oxidizing gas and dispersing said mixture throughout such bottom region of said bed of said fluidized combustor for combustion.

6. The apparatus of claim 1 or 2 wherein said supply means passes said fuel and gas and resulting combustion gases through said bed with a velocity sufficient to turbulate said fluidized bed particulate, whereby slugs of said bed particulate are regularly and turbulently pulsated through said freeboard zone of said combustor.

7. The apparatus of claim 1 or 2 wherein said cooling fluid substantially surrounds the perimeter of said freeboard zone and said bed.

8. The apparatus of claim 7 wherein said cooling fluid comprises air.

9. The apparatus of claim 1 or 2 wherein said fluidized bed combustor includes exhaust means proximate the top of said first vessel, said exhaust means exhausting spent combustion products produced by the combustion of said fuel from said freeboard zone of said fluidized bed combustor.

10. The apparatus of claim 9 wherein said exhaust means separates solid particulate combustion products from gaseous combustion products.

11. The apparatus of claim 10 wherein said exhaust means includes a cyclone separator means for separating such solid particulate combustion products from such gaseous combustion products.

12. An improved fluidized bed combustor apparatus for producing a clean heated fluid, said fluidized bed combustor defining a bed of particulate media and a freeboard zone above said bed, said apparatus comprising, in combination:

a first vessel containing said bed of particulate media and said freeboard zone;

a second vessel spaced from and surrounding said first vessel, thereby defining a longitudinal annular space between said first vessel and said second vessel;

means for supplying a finely divided fuel and oxidizing gas to said bed for combustion connected proximate the bottom of said first vessel, said supply means passing such fuel and gas and the resulting combustion gases through said bed with a velocity sufficient to turbulate said fluidized bed media particulate and propel slugs of said bed media particulate regularly and turbulently through said freeboard zone, said media particulate absorbing the heat of combustion creating a negative temperature gradient extending from a point proximate the bottom of said bed of particulate media upwardly through said freeboard zone, and, means for providing a supply of cooling fluid of said longitudinal annular space providing therein a flow of said cooling fluid counter to the flow of said fuel and gases, said cooling fluid absorbing heat from said first vessel to enhance and regulate said negative temperature gradient in said first vessel.

13. The apparatus of claim 12 in which said fluidized bed combustion consists of two or more sets of said first and second vessels.

14. The apparatus of claim 12 or 13, wherein said second vessel is encapsulated within insulating means.

15. The apparatus of claim 12, wherein said cooling gas supply means further includes means for automatically modulating said supply of cooling gas to said annular space to hold the temperature profile of said bed and said freeboard zone within predetermined limits.

* * * * *